United States Patent [19]

Dill

[11] Patent Number: 4,472,852

[45] Date of Patent: Sep. 25, 1984

[54] CARBON ELECTRODE CLEANING SYSTEM

[76] Inventor: Raymond J. Dill, 1910 Erskine Dr., Florence, Ala. 35630

[21] Appl. No.: 510,659

[22] Filed: Jul. 5, 1983

[51] Int. Cl.[3] ..... B08B 1/00

[52] U.S. Cl. ..... 15/91; 29/81 E

[58] Field of Search ..... 15/4, 89, 91, 92, 104.07, 15/21 E; 29/81 E, 81 F, 81 J; 134/6; 164/158; 204/129.35

[56] References Cited

U.S. PATENT DOCUMENTS 1,597,332 8/1926 Waddell et al. ..... 29/81 E 3,343,986 9/1967 Howery et al. ..... 15/89

FOREIGN PATENT DOCUMENTS 0636047 12/1978 U.S.S.R. ..... 15/91

*Primary Examiner*—Edward L. Roberts

*Attorney, Agent, or Firm*—Phillips & Hoelter

[57] ABSTRACT

An electrode cleaning apparatus wherein a carbon electrode is maneuvered between a pair of spaced counter-rotating vertical shafts having flailing elements connected thereto. This occurs within an enclosure having a lower hopper that directs flailed residue to an opening and onto an adjacent conveyor. The electrode is suspended within the enclosure by a hoist supported on a track which extends through the enclosure.

5 Claims, 11 Drawing Figures

CARBON ELECTRODE CLEANING SYSTEM

TECHNICAL FIELD

This invention relates generally to a system for cleaning electrodes employed in the smelting of aluminum.

BACKGROUND ART

Large blocks of carbon are employed as anode electrodes in the smelting process in which aluminum is manufactured. While an electrode is substantially consumed during its useful life, there does remain a fairly large volume of carbon left, particularly in the upper region of an electrode where metallic, electrical connecting rods are embedded in the carbon. Since the quantity of carbon left is fairly substantial, it is customary in the industry to reclaim it and use it in the manufacture of new carbon electrodes. Unfortunately, before this can be done, used electrodes must be cleaned to remove a surface encrustation of alumina and cryolite which builds up during the smelting process. This encrustation is white in color and thus easily distinguishable from carbon which is, of course, black. In general, three methods or approaches are known to be presently employed to remove this coating. In one, there is utilized a combination of manual hammering and scraping of the electrodes. In a second one, powered (pneumatically or hydraulically) scraping arms operate on the electrodes. In the third one, a vibrating scraping tool is employed. Significantly, each of the methods are generally regarded as being unduly slow and labor intensive.

Another pertinent factor is that smelting plants normally manufacture their own electrodes as a companion function to smelting, and thus the electrode manufacturing process must keep step with the smelting process. This requires that the labor force employed in cleaning electrodes always be maintained at or above a critical number or else some shutdown of the smelting operations may be necessary should the cleaning operation fall behind. Inasmuch as the time required to clean an electrode may vary significantly when performed as described, it is typical that a plant will err on the safe side and at times may have larger that necessary crews working in the cleaning operation. In any event, there is general agreement in the smelting industry that the electrode cleaning operation takes too much time and is too expensive.

Accordingly, it is an object of this invention to provide an improved system for the cleaning of large carbon electrodes.

SUMMARY OF THE INVENTION

In accordance with this invention, a flailing system is constructed in which a pair of spaced, counterrotating, vertical shafts, each having a plurality of horizontally extending flailing elements, are operated within a walled hopper. A carbon electrode is suspended from a traveling crane which moves the electrode into and through the path of the flailing elements. Contact between the electrode and the flailing elements is effected by controlled horizontal and vertical movement of the electrode and by adjustment of the relative speeds of rotation of the two shafts, which enables all the surface area of an electrode to be cleaned.

DETAILED DESCRIPTION OF THE INVENTION

Figure 1:
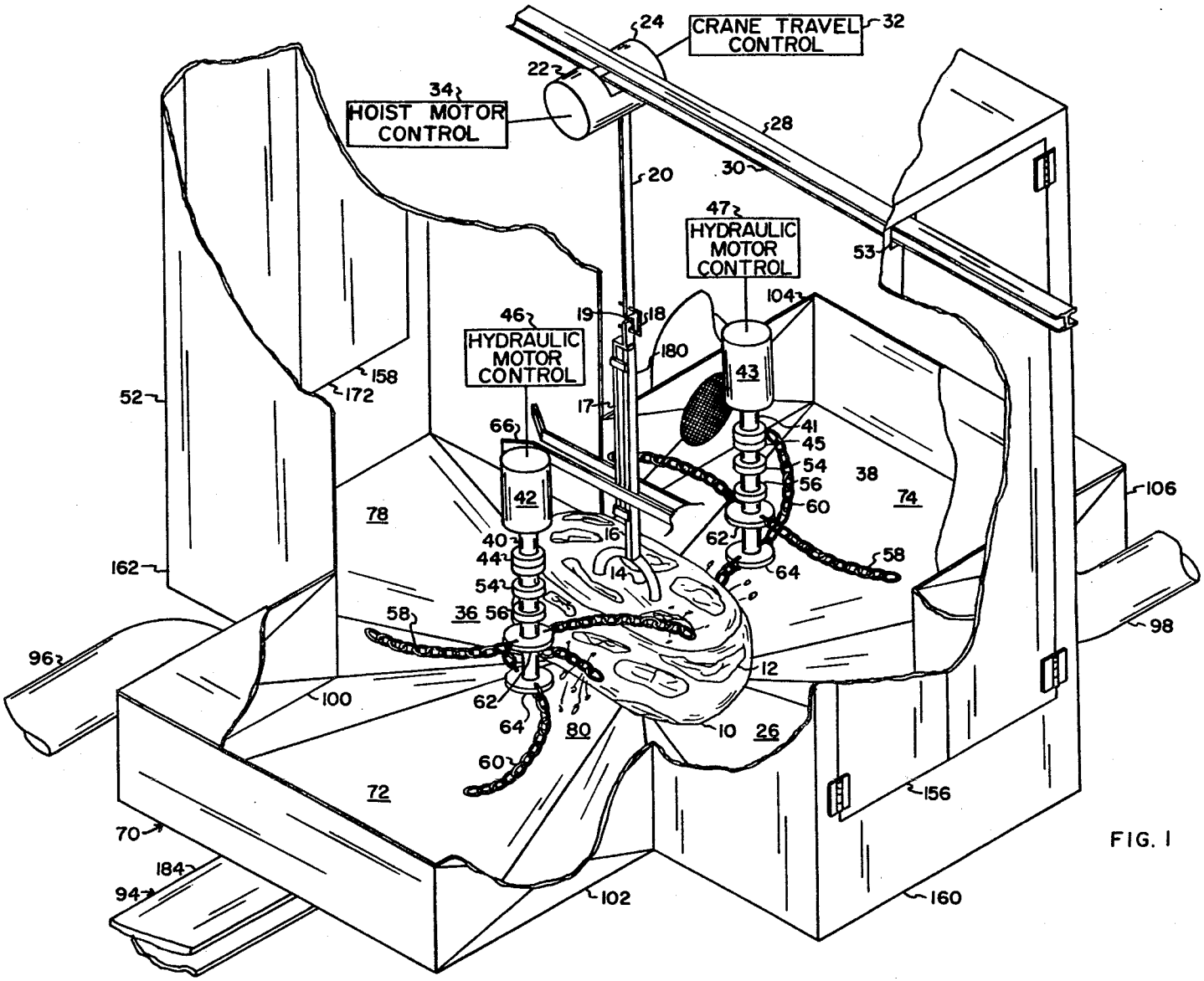
FIG. 1 is a diagrammatic view of an embodiment of the invention.

Referring initially to FIGS. 1–4, there is shown a general arrangement of the components of the applicant's system. Carbon electrode 10 is illustrative of an electrode to be cleaned, it having irregular encrustations 12 of alumina and cryolite built up from its use in the smelting of aluminum. Conventionally, electrode 10 is constructed having a built-in yoke 14 of conductive steel. There extends from yoke 14 an electrically conductive bar 16 which is typically constructed of a lower resistive material than steel, such as aluminum, to reduce electrical losses over its length. Prior to the flailing of electrode 10, a bumper bar 17 is secured along a portion of the length of bar 16, and this bumper bar 17 contains an upper opening 19 through which hook member 18 is inserted.

Electrode 10 is suspended via bumper bar 17 on strap or cable 20 from hoist 22 of traveling crane 24. Crane 24 is supported by a pair of rollers 26 on a generally horizontal track 28 that is formed by an I beam 30. Crane 24 is conventionally driven along track 28 by means of an internal horizontal drive motor (not shown) which drives one or both rollers 26. Horizontal movement is controlled by a conventional crane travel control 32 which supplies power to the horizontal drive motor of crane 24. Vertical movement of the electrode is effected by hoist 22, which includes a conventional drive motor (not shown) for this purpose, vertical movement being controlled by a conventional hoist motor control 34.

Figure 3:
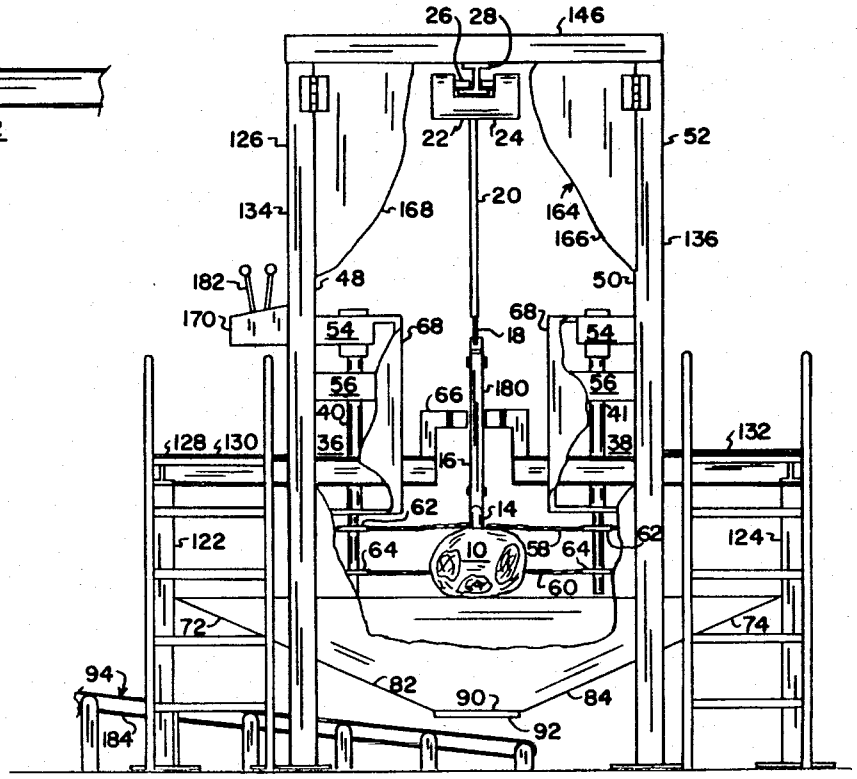
FIG. 3 is a side view, partially cut away, of an embodiment of the invention.

Encrustations 12 of alumina and cryolite on electrode 10 are rapidly and controllably abraded away by two spaced flailing assemblies 36 and 38, these being equally spaced on opposite sides of I beam 30. Each flailing assembly 36 and 38 employs a vertical shaft 40 and 41, respectively. Each shaft 40 and 41 is separately driven by variable speed hydraulic motors 42 and 43. These motors are connected to their respective shafts by conventional shear pin couplings 44 and 45. Each of these motors 42 and 43 are independently controlled by separate hydraulic motor controls 46 and 47, as shown diagrammatically in FIG. 1. One motor control operates a hydraulic motor to rotate the shaft clockwise, while the other motor control operates the other hydraulic motor to rotate the other shaft counterclockwise. Flailing assemblies 36 and 38 are supported on the inner side of opposite side walls 48 and 50 of an elongated enclosure 52 by upper and lower mounted bearings 54 and 56 secured to these side walls 48 and 50 as shown in FIG. 3.

Flailing is effected by an upper pair of flailing chains 58 and an orthogonally positioned lower pair of flailing chains 60. Upper chains 58 are pivotally attached to an upper plate 62 on each shaft 40 and 41, and lower flailing chains 60 are supported on a lower circular plate 64 on each shaft 40 and 41 (FIGS. 1 and 3).

As a means of preventing electrode 10 from getting closer than a selected minimum distance to the chain holding circular plates 62 and 64, a pair of parallel guide bars 66, one supported from each side wall 48 and 50, is positioned intermediately between flailing assemblies 36 and 38, respectively. These guide bars 66 are longitudinally spaced from each other to permit bars 16 and 17 supporting electrode 10 to be moved between these guide bars with some freedom of movement but not enough to allow upper or lower flailing chains 58 or 60 to snag electrode 10 or bars 16 and 17. The space between guide bars 66 and the combination of both bars 16 and 17 prevent electrode 10 from rotating on cable 20 while it is being flailed. There is illustrated in FIG. 3 an optional cover plate 68 which generally surrounds the upper portion of each flailing assembly 36 and 38. This cover plate 68 is attached by means not shown to each of side walls 48 and 50.

Figure 5:
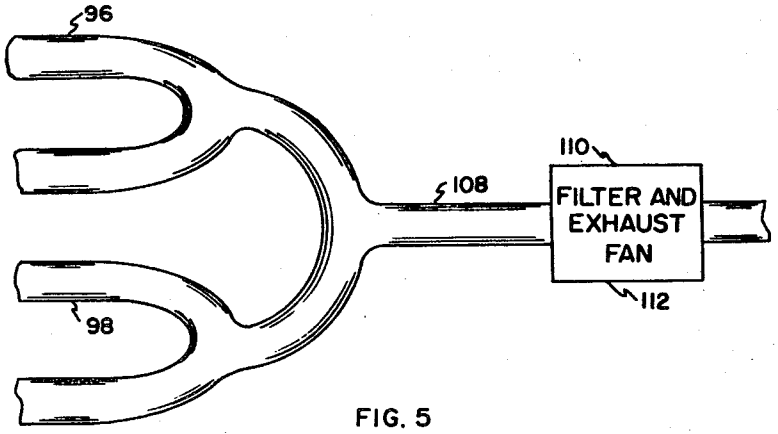
FIG. 5 is a diagrammatic view, partially cut away, of the particulate filter system.

The flailing operation occurs within hopper 70. Hopper 70 is horizontally configured generally in the shape of a cross wherein there are four outer sectors 72, 74, 76 and 78 and a central or middle sector 80. Track 28, which carries crane 24 and thus electrode 10, extends centrally over and across sectors 76 and 78 and central sector 80. These four outer sectors have sloping bottom surfaces 82, 84, 86, and 88 which extend downward to a central bottom opening 90, as particularly shown in FIG. 2. Opening 90 has turned-down flanges 92 around its perimeter to guide the flow of debris out of hopper 70. Belt conveyor 94 is positioned directly under opening 90 to receive this debris via gravity, and conveyor 94 transports this debris to a storage bin (not shown). The flailed material is later mechanically crushed and returned to the smelting furnace where it is added back into the smelting process. By this configuration, debris from the flailing operation is efficiently and effectively removed from hopper 70. Further, this configuration enables the connection of a pair of exhaust ducts 96 and 98 closely proximate to the high dust regions in opposite sectors 72 and 74 of hopper 70. The removal of dust via these ducts materially enhances the visibility of the cleaning operation. Thus, as shown, one pair of ducts 96 is in opposite walls 100 and 102 of sector 72, and a second pair of exhaust ducts 98 is in opposite walls 104 and 106 of sector 74. These ducts 96 and 98 are connected through duct pipes 108 shown in FIG. 5 to a central filter 110, and exhaust fan 112 is connected to filter 110 which draws dust particles from hopper 70 into filter 110. Filter 110 includes a collection reservoir for dust drawn into it, which is then appropriately disposed of.

Figure 2:
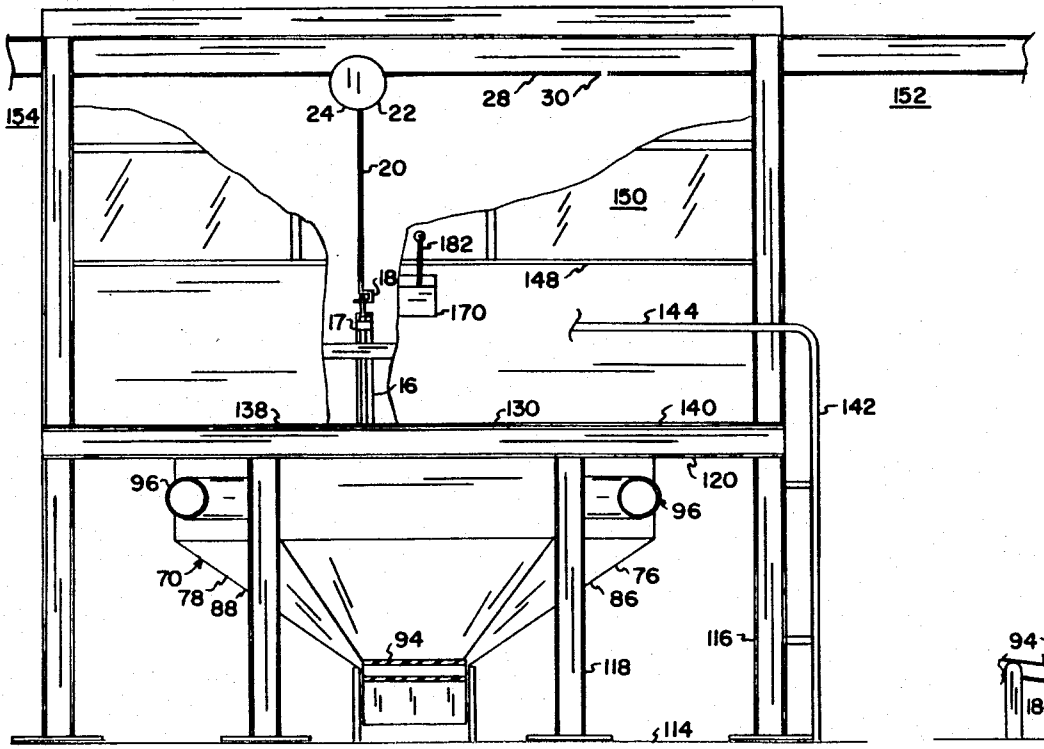
FIG. 2 is a front view, partially cut away, of an embodiment of the invention.

Referring particularly to FIGS. 2 and 3, hopper 70 is supported above the floor or ground 114 by structural frame 116, which is bolted or welded together in a conventional fashion. Frame 116 consists of upright support beams 118 and lateral support beams 120 which are generally formed of structural I beams. Structural frame 116 also connects to and supports enclosure 52, which extends above and around hopper 70.

Discrete base portions 122 and 124 of enclosure 52 extend over sectors 72 and 74, and raised or side wall portion 126 extends as a rectangular cover around and over outer sectors 76 and 78 and central sector 80. The upper surface 128 of each base portion 122 and 124 serves as a portion of the floor of one of elevated walkways 130 and 132. Each walkway 130 and 132 extends along each side 134 and 136 of the raised or side wall portion 126 of enclosure 52. Floor regions 138 and 140 extend laterally on each side 134 and 136 of enclosure 52 from base portions 122 and 124 and completes each walkway 130 and 132. Ladders 142 on each side 134 and 136 of enclosure 52 are supported by structural frame 116 and provide access to one of walkways 130 and 132. Each ladder 142 provides a support for outer hand rails 144 which extend along each of walkways 130 and 132. Raised side wall portion 126 and top 146 of enclosure 52 provide a dust and debris cover. This enclosure 52 generally prevents the escape of dust and debris from within enclosure 52, and portions of it, particularly side wall portion 126 and base portions 122 and 124, are typically constructed of steel plate. One exception is that there is a viewing area 148 on each of opposite sides 134 and 136 of enclosure 52 which is constructed of a reinforced transparent material 150, such as a steel reinforced acrylic plate.

The loading and unloading of the electrodes onto and from hoist 22 are typically effected from a loading and unloading zone 152 and 154 as illustrated in FIG. 2. Accordingly, track 28 extends through enclosure 52 via opening 53 (FIG. 1) and between these zones 152 and 154. To accommodate this configuration, closable openings 156 and 158 are provided on each of opposite sides 160 and 162 of enclosure 52. One of these is illustrated in FIG. 3 by door 164 which is formed of two swinging door units 166 and 168, each being spring biased to normally remain in a closed position but being openable upon being engaged by an electrode as it is moved inward or outward by crane 24.

Crane travel control 32 and hoist motor control 34 for the control of crane 24 and hoist 22, respectively, and hydraulic motor controls 46 and 47, which control the speed of rotation of vertical shafts 40 and 41 in each of flailing assemblies 36 and 38, are located in control panel 170 centrally positioned on side 134 of enclosure 52. Control panel 170 is positioned along walkway 130 just below transparent viewing area 148 in side 134 of enclosure 52. This allows an operator to effect control of the operation while looking down inside hopper 70.

To examine the operation of the electrode cleaning system of this invention, a partially consumed carbon electrode is illustrated in FIGS. 1–4 by carbon electrode 10 having on it an encrustation 12 of alumina and cryolite. Hoist control 34 and crane travel control 32 are activated from control panel 170 by an operator standing upon walkway 130 to lift electrode 10 upward. This is accomplished by inserting hook member 18 into opening 19 in the upper end region 180 of bumper bar 17. Once inserted, crane 24 is operated to suspend electrode 10 above the ground 114 from track 28, and then hoist 22 is activated to move this suspended electrode 10 through door units 166 and 168 which separate electrode loading zone 152 from the interior of the raised portion 126 of enclosure 52. At this time, both hydraulic motor controls 46 and 47 are engaged by controls 182 to operate hydraulic motors 42 and 43 in order to rotate vertical shafts 40 and 41 in flailing assemblies 36 and 38, respectively. Generally, electrode 10 is moved along track 28 by hoist 22 until it is suspended between guide bars 66 and directly above upper pairs of flailing chains 58. Then, crane 24 lowers electrode 10 between vertical shafts 40 and 41 and within flailing range of upper and lower chains 58 and 60 to remove the encrustations 12 of alumina and cryolite on electrode 10. While being flailed, electrode 10 is maneuvered forward and backward by hoist 22 and upward and downward by crane 24 to insure that all of encrustation 12 is removed.

Figure 6:
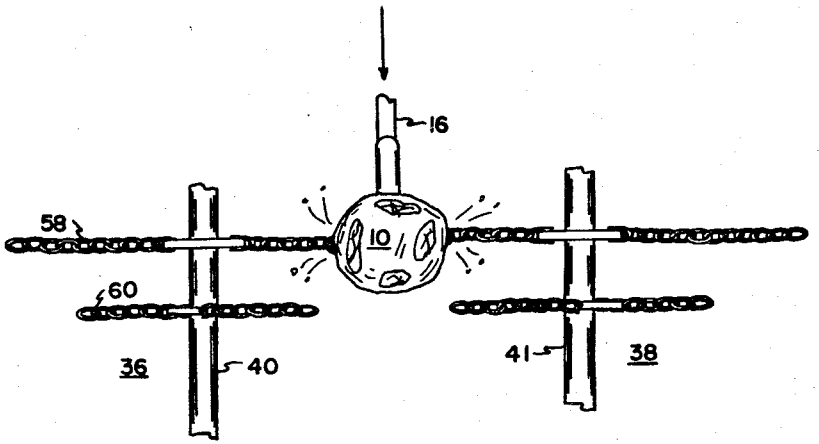
FIG. 6 is a side view of the operation of the flailing assemblies.

Referring now to FIG. 6, electrode 10 is shown being lowered toward flailing chains 58 and 60, with its bottom side being positioned within the flailing range of upper flailing chains 58. The bottom side of electrode 10, as well as portions of its right and left sides, is partially flailed while passing through the flailing range of upper flailing chains 58, and the flailing process for these right, left, and bottom sides is completed as they pass within the flailing range of lower flailing chains 60.

Figure 7:
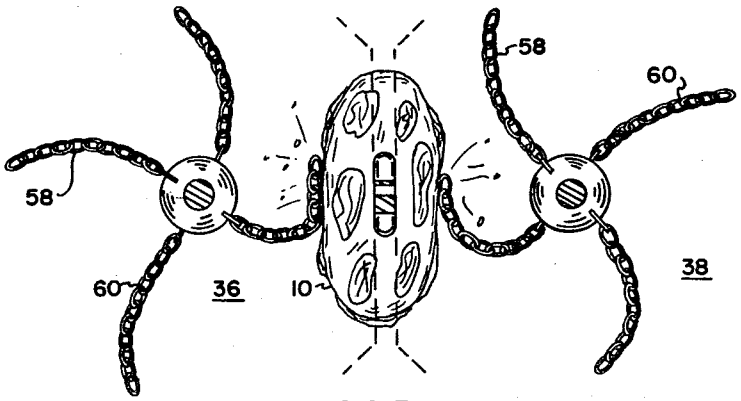
FIG. 7 is a top view of the operation of the flailing assemblies showing the removal of side encrustations.
Figure 4:
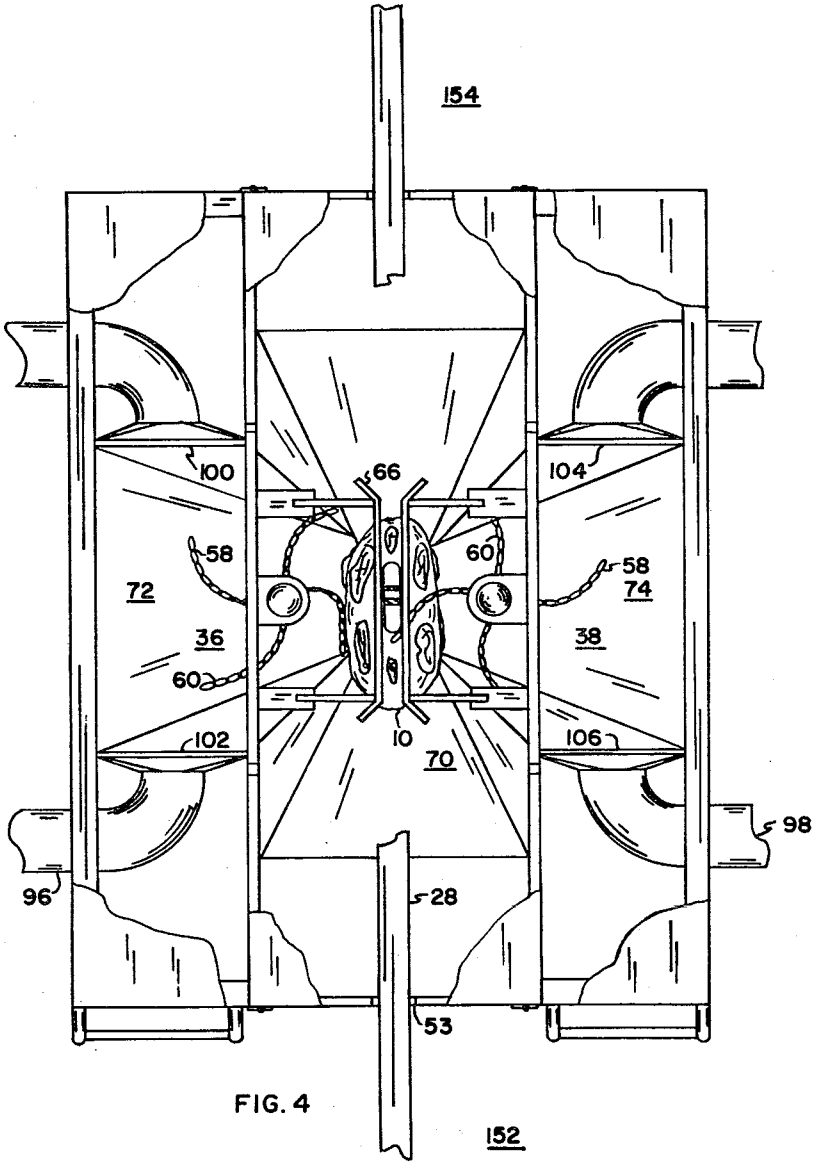
FIG. 4 is a top view, partially cut away, of an embodiment of the invention.
Figure 8:
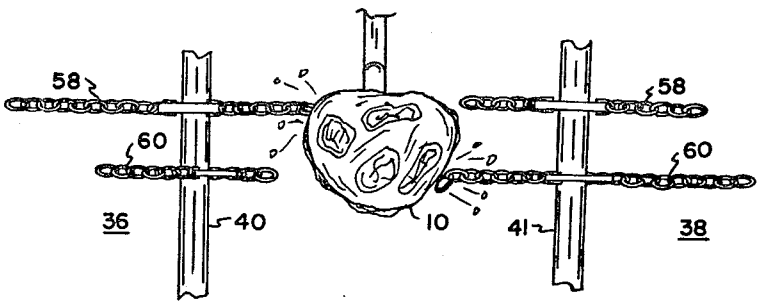
FIG. 8 is a side view of the operation of the flailing assemblies showing the removal of side encrustations.

Referring now to FIGS. 7 and 8, the bottom side of electrode 10 has passed through the flailing range of lower flailing chains 60, and its right and left sides are currently being flailed by both upper and lower flailing chains 58 and 60, respectively. This flailing process continues until encrustations 12 on these sides have been removed.

Figure 9:
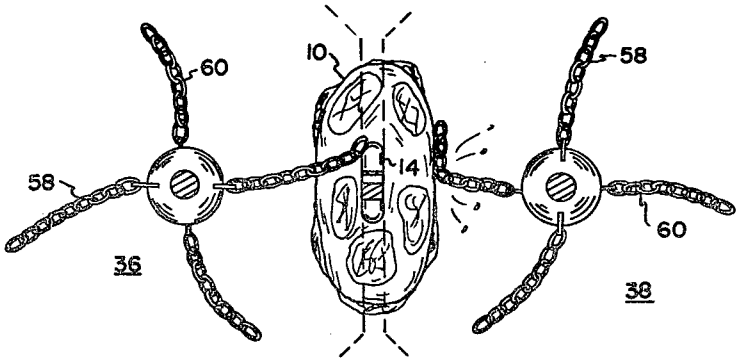
FIG. 9 is a top view of the operation of the flailing assemblies similar to FIG. 7 except illustrating the remove of top encrustations.
Figure 10:
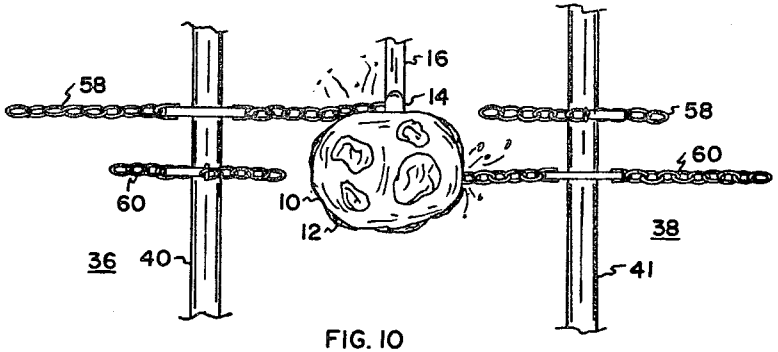
FIG. 10 is a side view of the operation of the flailing assemblies similar to FIG. 8 except illustrating the removal of top encrustations.

FIGS. 9 and 10 illustrate electrode 10 having its top surface flailed. Upper flailing chains 58 are of a length which allows them to partially extend around and through yoke 14 and to clean any encrustation 12 found there. This length is not so great, however, as to allow these upper chains 58 to wrap around yoke 14, thereby snagging electrode 10 and pulling it inward toward their respective flailing assembly. Guide bars 66 (FIG. 9) keep electrode 10 sufficiently spaced from flailing assemblies 36 and 38 to prevent any snagging by upper flailing chains 58. Thus, as the top of electrode 10 passes through the flailing range of these upper chains 58, any encrustations 12 found there are removed.

Depending upon the overall length of electrode 10, crane 24 may be pitched forward or backward to move electrode 10 forward or backward while it is being flailed in order to clean along its entire length. Furthermore, as the front region of the left and right sides of electrode 10 are being cleaned, the front side of electrode 10 is simultaneously being cleaned. Similarly, as the back or rear regions of the left and right sides of electrode 10 are being cleaned, the back or rear side of electrode 10 is also being cleaned.

After all sides of electrode 10 are cleaned, whether or not the operator was required to lower the electrode or move it forward or backward to accomplish this task, electrode 10 is maneuvered away from both the upper and lower pairs of flailing chains 58 and 60 by hoist 22 and crane 24. The operator is able to determine whether electrode 10 is cleaned by his observance of the flailing operation through viewing area 148 in either side 134 or 136 of enclosure 52. Thus, once the unspent black carbon is showing on all sides, the operator manipulates controls 182 in control panel 170 to transfer electrode 10 out swinging doors 172 in side 162 of raised portion 126 of enclosure 52 via track 28. Once outside enclosure 52 and in electrode unloading zone 154, electrode 10 is set back on the ground 114, and hook member 18 is removed from opening 19 in bar 17. Hoist 22 and crane 24 then pass back through enclosure 52 on track 28 to electrode loading zone 152 where another carbon electrode (not shown) is hoisted above the ground and enters enclosure 52 to begin the flailing process all over again.

The alumina and cryolite encrustations 12 that are removed from electrode 10 during the flailing process are contained as much as possible within enclosure 52. The larger non-airborne granules which fall down toward the bottom of hopper 70 roll or slide toward bottom opening 90 where they fall onto belt 184 of conveyor 94. This conveyor transports these granules to a storage bin or crusher (not shown), depending on their size, and they are later transported back to the smelter where they are added back to the smelter furnaces.

The smaller airborne particulates are sucked out of hopper 70 via ducts 96 and 98 in hopper sections 72 and 74. These airborne particulates are drawn along inside duct pipe 108 by exhaust fan 112 to filter 110 where they are collected and then disposed of.

As previously mentioned, flailing assemblies 36 and 38 are separately driven. This is accomplished by having each vertical shaft 40 and 41 connected to separate hydraulic motors 42 and 43 via shear pin couplings 44 and 45, respectively. Additionally, separate motor controls 46 and 47 for each motor 42 and 43 are located in control panel 170. By varying the speed of rotation for vertical shafts 40 and 41, an operator is able to vary the rate of cleaning of electrode 10. Thus, if electrode 10 is only slightly encrusted, the rate of rotation of flailing assemblies 36 and 38 can be adjusted accordingly. Alternately, should one side of electrode 10 be encrusted thicker than the other side, the rate of rotation between these flailing assemblies 36 and 38 can be altered accordingly. Thus, with skill, an operator is able to flail a portion of the surface of an electrode only so long as is needed and no more so as to minimize the loss of the usable carbon while insuring the removal of all undesired encrustations 12.

Figure 11:
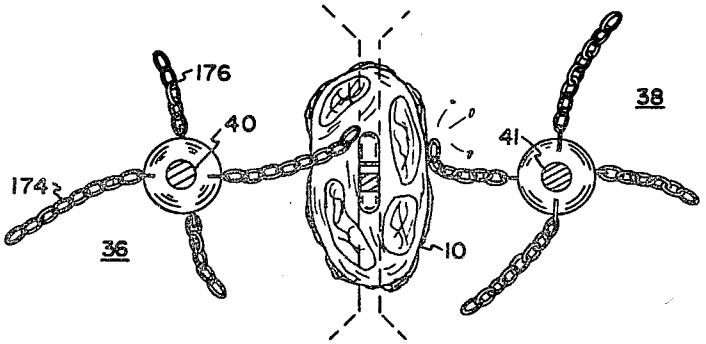
FIG. 11 is a top view, partially cut away, of an alternate embodiment of the flailing chains.

An alternate embodiment of the applicant's system is shown in FIG. 11. In this embodiment, the length of upper flailing chains 174 are greater in length than lower flailing chains 176 in each flailing assembly 36 and 38. These differences in length provide for more efficient cleaning of the electrode surfaces. This is because in the flailing process, it is the sharp whip-like action of the flail against the workpiece which causes the workpiece to come clean. When a long flail strikes a workpiece, the excess of this longer flail tends to be dragged across the workpiece rather than whipping it as preferred. Thus, electrode surfaces closer to rotating shafts 40 and 41 (the right and left sides) are more efficiently cleaned with a shorter chain, while obviously, electrode surfaces farther from rotating shafts 40 and 41 (the top, bottom, front, and back sides) require a longer chain. Thus, different length chains insure that regardless of the distance between the to-be-cleaned electrode surface and the rotating shaft, each surface is capable of being subject to a whip-like action rather than a dragging action by the flailing chains. The ability of the operator to control the position of the electrode while it is being flailed permits each surface to be cleaned at its most effective and efficient rate.

I claim:

1. A carbon electrode cleaning system comprising:

first and second flailing assemblies comprising:

first and second horizontally spaced vertical shafts, first motive means for rotating said first shaft in first direction, and second motive means for rotating said second shaft in a second and opposite direction, a first plurality of flailing elements attached to said first shaft and extending horizontally when said first shaft is rotating, a second plurality of flailing elements attached to said second shaft and extending horizontally when said second shaft is rotated, a hopper having side walls around said flailing assemblies and having an opening in the bottom of said hopper, a hoist adopted to vertically suspend a carbon electrode, horizontal positioning means for horizontally and relatively positioning said shafts of said flailing assemblies and said carbon electrode, vertical positioning means for vertically and relatively positioning said flailing elements and said carbon electrode, and speed control means for varying the speed of said counter rotating vertical shafts, whereby the speeds of the shafts may be relatively varied to thereby enable discrete areas of the electrode to be selectively cleaned by flailing elements.

2. A system as set forth in claim 1 wherein said horizontal positioning means comprises means for selectively positioning said hoist.

3. A system as set forth in claim 1 further comprising first guide means positioned between said first shaft and said electrode for blocking the movement of said electrode toward said first shaft, and second guide means positioned between said second shaft and said electrode for blocking the movement of said electrode toward said second shaft.

4. A system as set forth in claim 1 wherein each said plurality of flailing elements comprises at least one pair of chains diametrically and oppositely coupled to a said shaft.

5. A system as set forth in claim 4 wherein there is at least one coupling plate around and supported on each said shaft, and a said pair of chains are diametrically and oppositely attached to said coupling plate.

* * * * *